US009425496B2

(12) United States Patent
Zhu et al.

(10) Patent No.: US 9,425,496 B2
(45) Date of Patent: Aug. 23, 2016

(54) DISTRIBUTED LOOP SPEAKER ENCLOSURE ANTENNA

(71) Applicant: Apple, Inc., Cupertino, CA (US)

(72) Inventors: Jiang Zhu, Sunnyvale, CA (US); Qingxiang Li, Mountain View, CA (US); Robert W. Schlub, Cupertino, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 564 days.

(21) Appl. No.: 13/629,061

(22) Filed: Sep. 27, 2012

(65) Prior Publication Data

US 2014/0086441 A1 Mar. 27, 2014

(51) Int. Cl.
*H01Q 1/24* (2006.01)
*H01Q 1/44* (2006.01)
*H01Q 7/00* (2006.01)

(52) U.S. Cl.
CPC ..... *H01Q 1/243* (2013.01); *H01Q 1/44* (2013.01); *H01Q 7/00* (2013.01)

(58) Field of Classification Search
CPC ..... H01Q 1/243; H01Q 1/44; H01Q 7/00
USPC ..... 345/173; 455/41.1, 41.2, 77, 566; 343/700 MS, 702, 846, 848, 866, 893; 381/315, 332; 379/431
See application file for complete search history.

(56) References Cited

U.S. PATENT DOCUMENTS 2,322,126 A 6/1943 Grimditch
5,877,728 A 3/1999 Wu et al.
6,201,501 B1 * 3/2001 Arkko ..... H01Q 1/243 343/700 MS
7,227,504 B2 6/2007 Deguchi et al.
7,233,678 B2 6/2007 Erixon et al.
(Continued)

FOREIGN PATENT DOCUMENTS

CN 1679304 10/2005
CN 102683861 9/2012
(Continued)

OTHER PUBLICATIONS

Apple Inc., U.S. Appl. No. 13/629,005, filed Sep. 27, 2012.
(Continued)

*Primary Examiner* — Md S Elahee
(74) *Attorney, Agent, or Firm* — Treyz Law Group, P.C.; G. Victor Treyz; Michael H. Lyons

(57) ABSTRACT

An electronic device may be provided with antenna structures. The antenna structures may be formed using a dielectric carrier structure such as a speaker enclosure, so that interior space within the electronic device that is occupied by a speaker can be used in forming an antenna. A speaker driver may be mounted in the speaker enclosure. Openings in the speaker enclosure may allow sound from the speaker driver to be emitted from the speaker enclosure. The antenna structures may have first and second loop antenna resonating elements. The first loop antenna resonating element may indirectly feed the second loop antenna resonating element. The second loop antenna resonating element may be a distributed loop element formed from a strip of metal with a width that loops around the speaker enclosure. Openings in the second loop antenna resonating element may be aligned with the speaker enclosure openings.

23 Claims, 15 Drawing Sheets

(56) References Cited

U.S. PATENT DOCUMENTS

| | | | | |
|---|---|---|---|---|
| 7,342,539 | B2 | 3/2008 | Rosenberg et al. | |
| 7,446,729 | B2 | 11/2008 | Maruyama et al. | |
| 7,463,121 | B2 | 12/2008 | D'Ostilio | |
| 7,782,257 | B2 | 8/2010 | Kim et al. | |
| 8,009,119 | B2 * | 8/2011 | Hung | H01Q 1/38 343/893 |
| 8,963,794 | B2 * | 2/2015 | Zhu | 343/866 |
| 2002/0075185 | A1 * | 6/2002 | Wang | H01Q 1/243 343/700 MS |
| 2004/0044382 | A1 | 3/2004 | Ibrahim | |
| 2004/0203997 | A1 * | 10/2004 | Kaikuranta | H01Q 1/243 455/550.1 |
| 2005/0012674 | A1 * | 1/2005 | Takei | H01Q 1/243 343/767 |
| 2006/0111163 | A1 * | 5/2006 | Oh | H01Q 1/242 455/575.7 |
| 2007/0080889 | A1 | 4/2007 | Zhang | |
| 2007/0176846 | A1 | 8/2007 | Vazquez et al. | |
| 2009/0061966 | A1 * | 3/2009 | Yang | H01Q 1/243 455/575.7 |
| 2009/0167616 | A1 | 7/2009 | Chen | |
| 2010/0073241 | A1 | 3/2010 | Ayala Vazquez et al. | |
| 2010/0156741 | A1 | 6/2010 | Vazquez et al. | |
| 2010/0182205 | A1 | 7/2010 | Chiang | |
| 2010/0231481 | A1 | 9/2010 | Chiang et al. | |
| 2010/0290650 | A1 | 11/2010 | Ogura et al. | |
| 2011/0006953 | A1 | 1/2011 | Chiang et al. | |
| 2011/0050508 | A1 | 3/2011 | Guterman et al. | |
| 2011/0050509 | A1 | 3/2011 | Ayala Vazquez et al. | |
| 2011/0050531 | A1 * | 3/2011 | Yamaguchi | H01Q 1/2216 343/842 |
| 2012/0194393 | A1 * | 8/2012 | Uttermann et al. | 343/702 |
| 2012/0218695 | A1 | 8/2012 | Sakai | |
| 2013/0050032 | A1 | 2/2013 | Shiu et al. | |
| 2013/0090058 | A1 * | 4/2013 | Zhu | H04M 1/03 455/41.1 |
| 2013/0223664 | A1 * | 8/2013 | Meskens et al. | 381/315 |

FOREIGN PATENT DOCUMENTS

| | | | | |
|---|---|---|---|---|
| EP | 1483880 | | 1/2010 | |
| FI | WO 2007135230 | A1 * | 11/2007 | H01Q 1/22 |
| TW | 200929686 | | 7/2009 | |
| WO | 02094370 | | 11/2002 | |
| WO | 2007135230 | | 11/2007 | |
| WO | WO 2007135230 | A1 * | 11/2007 | H01Q 1/22 |
| WO | 2011076582 | | 6/2011 | |
| WO | 2012049473 | | 4/2012 | |

OTHER PUBLICATIONS

Zhu et al., U.S. Appl. No. 13/299,123, filed Nov. 17, 2011.
Zhu et al., U.S. Appl. No. 13/216,073, filed Aug. 23, 2011.
Zhu et al., U.S. Appl. No. 13/540,999, filed Jul. 3, 2012.
Zhu et al., U.S. Appl. No. 13/629,061, filed Sep. 27, 2012.

* cited by examiner

DISTRIBUTED LOOP SPEAKER ENCLOSURE ANTENNA

BACKGROUND

This relates generally to electronic devices and, more particularly, to electronic devices with antennas.

Electronic devices are often provided with antennas. Challenges can arise in mounting antennas within an electronic device. For example, factors such as the relative position between an antenna and surrounding device structures and electrical components and factors such as the size and shape of antenna structures can have an impact on antenna tuning and bandwidth. If care is not taken, an antenna may become detuned or may exhibit an undesirably small efficiency bandwidth at desired operating frequencies.

It would therefore be desirable to be able to provide improved antennas for use in electronic devices.

SUMMARY

An electronic device may be provided with antenna structures. The antenna structures may be formed using a dielectric carrier structure such as a hollow plastic speaker enclosure, thereby allowing a volume in the interior of the device that is occupied by the speaker enclosure to be used as part of an antenna. A speaker driver may be mounted in the speaker enclosure. Openings in the speaker enclosure may be used to allow sound from the speaker driver to be emitted from the speaker enclosure.

The antenna structures may have first and second loop antenna resonating elements. The loop antenna resonating elements may be formed from metal traces on the speaker enclosure and, if desired, portions of a metal housing for the electronic device.

The first loop antenna resonating element may indirectly feed the second loop antenna resonating element. The second loop antenna resonating element may be formed from a strip of metal that loops around the speaker enclosure. A gap in the metal strip may form a capacitance in the second loop antenna resonating element. An inductance may also be formed in the second loop antenna resonating element. Openings in the second loop antenna resonating element may be aligned with the speaker enclosure openings. Segments of metal between the openings in the second loop antenna resonating element may collectively form the inductance for the second loop antenna resonating element.

The electronic device housing may have openings aligned with the speaker enclosure openings and the openings in the second loop antenna resonating element.

Further features of the invention, its nature and various advantages will be more apparent from the accompanying drawings and the following detailed description of the preferred embodiments.

DETAILED DESCRIPTION

Electronic devices may include antennas. The antennas may be used to transmit and receive wireless signals. Illustrative electronic devices that may be provided with antennas are shown in FIGS. 1, 2, 3, and 4.

Figure 1:
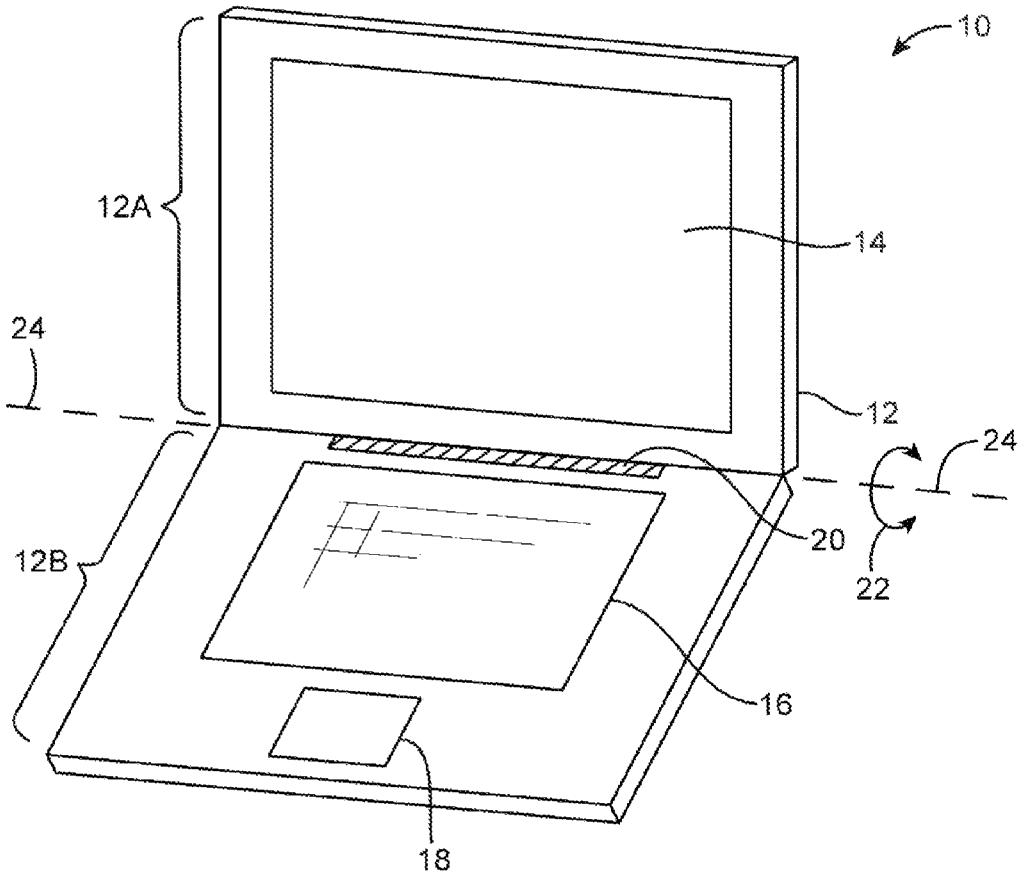
FIG. 1 is a perspective view of an illustrative electronic device such as a laptop computer that may be provided with antenna structures in accordance with an embodiment of the present invention.

FIG. 1 shows how electronic device 10 may have the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes referred to as a display housing or lid, may be placed in a closed position by rotating upper housing 12A towards lower housing 12B about rotational axis 24. Antenna structures may be mounted along the upper edge of upper housing 12A under a display cover layer associated with display 14 or elsewhere in device 10.

Figure 2:
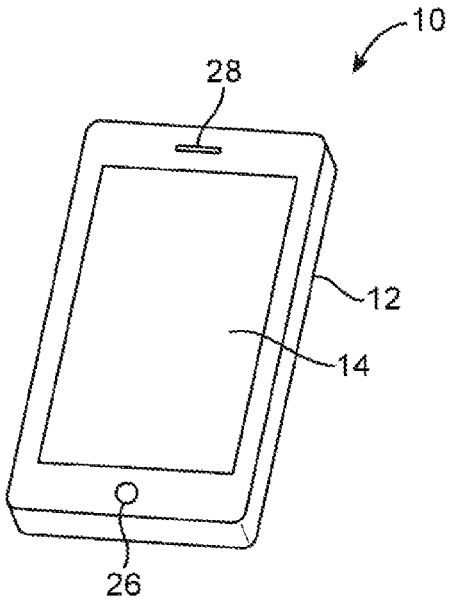
FIG. 2 is a perspective view of an illustrative electronic device such as a handheld electronic device that may be provided with antenna structures in accordance with an embodiment of the present invention.

FIG. 2 shows how electronic device 10 may be a handheld device such as a cellular telephone, music player, gaming device, navigation unit, or other compact device. In this type of configuration for device 10, housing 12 may have opposing front and rear surfaces. Display 14 may be mounted on a front face of housing 12. Display 14 may, if desired, have a display cover layer or other exterior layer that includes openings for components such as button 26. Openings may also be formed in a display cover layer or other display layer to accommodate a speaker port (see, e.g., speaker port 28 of FIG. 2). Antenna structures may be mounted under an inactive peripheral portion of the display cover layer for display 14 or elsewhere in housing 12 of FIG. 2.

Figure 3:
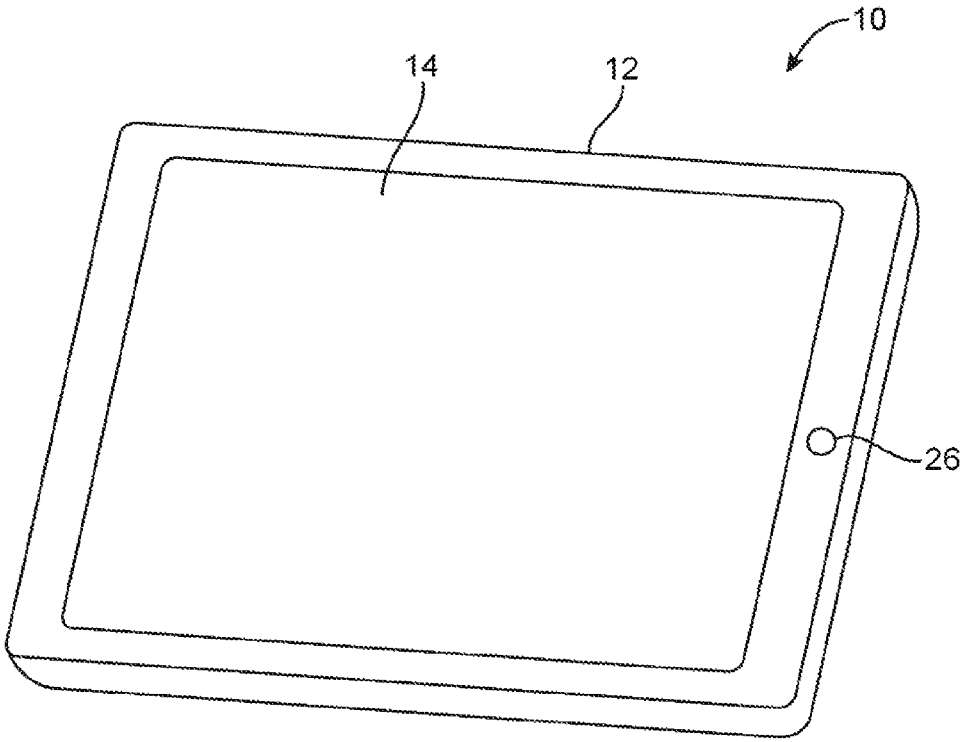
FIG. 3 is a perspective view of an illustrative electronic device such as a tablet computer that may be provided with antenna structures in accordance with an embodiment of the present invention.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have a display cover layer or other external layer with an opening to accommodate button 26 (as an example). Antenna structures may be mounted under one of the peripheral edges of the display cover layer or elsewhere within device 10.

Figure 4:
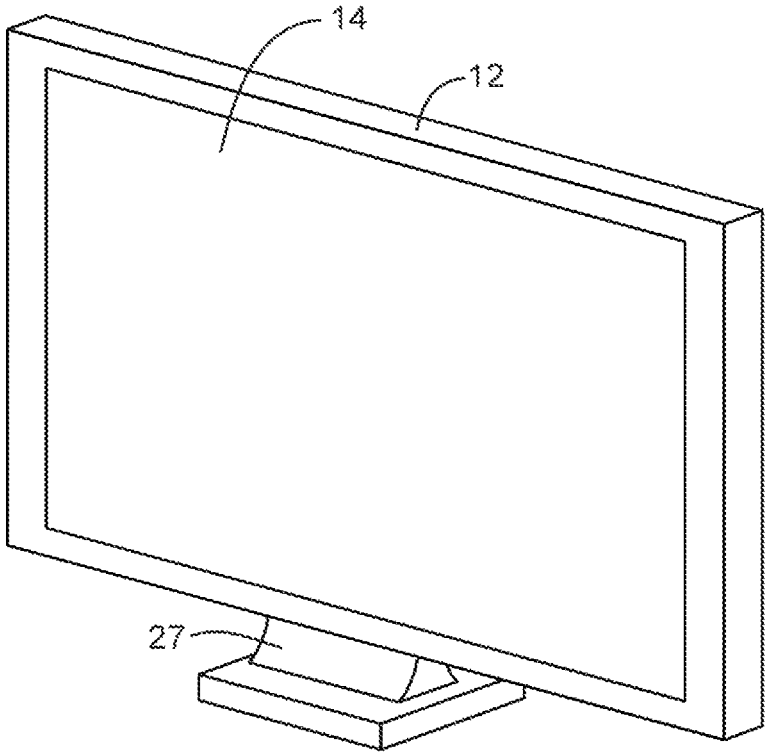
FIG. 4 is a perspective view of an illustrative electronic device such as a computer display with an integrated computer that may be provided with antenna structures in accordance with an embodiment of the present invention.

FIG. 4 shows how electronic device 10 may be a computer display or a computer that has been integrated into a computer display. With this type of arrangement, housing 12 for device 10 may be mounted on a support structure such as stand 27. Display 14 may be mounted on a front face of housing 12. Display 14 may, if desired, have a display cover layer. Antenna structures for device 10 of FIG. 4 may be mounted under one or more of the peripheral edges of the display cover layer or elsewhere within device 10.

The illustrative configurations for device 10 that are shown in FIGS. 1, 2, 3, and 4 are merely illustrative. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures). In configurations in which housing 12 is formed from metal or other conductive materials, dielectric structures such as plastic structures may be used to form antenna windows that overlap some or all of the antenna structures in device 10. Antenna structures in device 10 may also be configured to transmit and receive radio-frequency antenna signals through display cover layers and other dielectric structures in device 10.

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Displays for device 10 may, in general, include image pixels formed from light-emitting diodes (LEDs), organic LEDs (OLEDs), plasma cells, electrowetting pixels, electrophoretic pixels, liquid crystal display (LCD) components, or other suitable image pixel structures.

A display cover layer may cover the surface of display 14 or a display layer such as a color filter layer or other portion of a display may be used as the outermost (or nearly outermost) layer in display 14. A display cover layer or other outer display layer may be formed from a transparent glass sheet, a clear plastic layer, or other transparent member.

Touch sensor components such as an array of capacitive touch sensor electrodes formed from transparent materials such as indium tin oxide may be formed on the underside of a display cover layer, may be formed on a separate display layer such as a glass or polymer touch sensor substrate, or may be integrated into other display layers (e.g., substrate layers such as a thin-film transistor layer).

Figure 5:
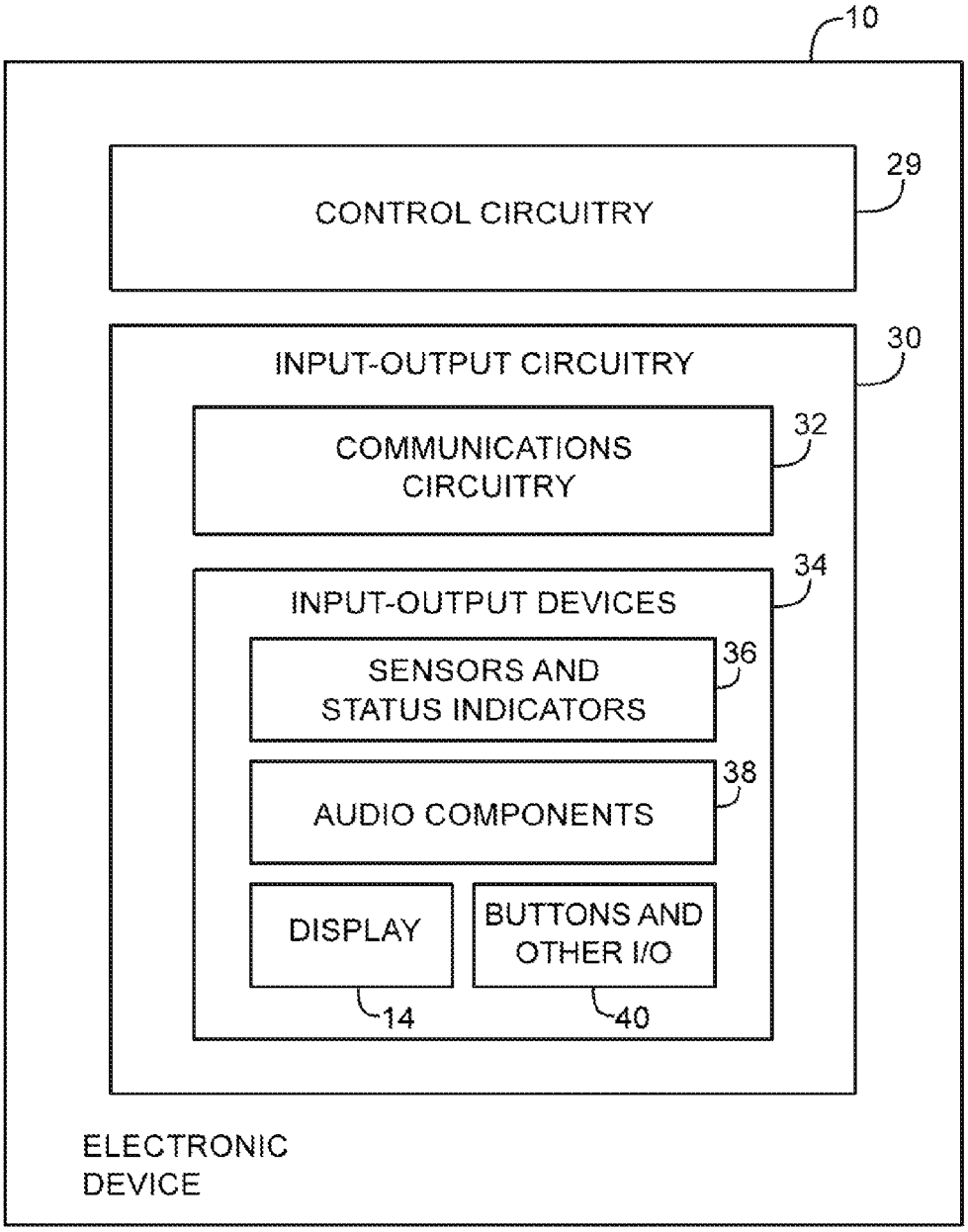
FIG. 5 is a schematic diagram of an illustrative electronic device with antenna structures in accordance with an embodiment of the present invention.

A schematic diagram of an illustrative configuration that may be used for electronic device 10 is shown in FIG. 5. As shown in FIG. 5, electronic device 10 may include control circuitry 29. Control circuitry 29 may include storage and processing circuitry for controlling the operation of device 10. Control circuitry 29 may, for example, include storage such as hard disk drive storage, nonvolatile memory (e.g., flash memory or other electrically-programmable-read-only memory configured to form a solid state drive), volatile memory (e.g., static or dynamic random-access-memory), etc. Control circuitry 29 may include processing circuitry based on one or more microprocessors, microcontrollers, digital signal processors, baseband processors, power management units, audio codec chips, application specific integrated circuits, etc.

Control circuitry 29 may be used to run software on device 10, such as operating system software and application software. Using this software, control circuitry 29 may present audio information to the user of device 10 using speakers and other audio circuitry, may use antenna structures and radio-frequency transceiver circuitry to transmit and receive wireless signals, and may otherwise control the operation of device 10.

Input-output circuitry 30 may be used to allow data to be supplied to device 10 and to allow data to be provided from device 10 to external devices. Input-output circuitry 30 may include communications circuitry 32. Communications circuitry 32 may include wired communications circuitry for supporting communications using data ports in device 10. Communications circuitry 32 may also include wireless communications circuits (e.g., circuitry for transmitting and receiving wireless radio-frequency signals using antennas).

Input-output circuitry 30 may also include input-output devices 34. A user can control the operation of device 10 by supplying commands through input-output devices 34 and may receive status information and other output from device 10 using the output resources of input-output devices 34.

Input-output devices 34 may include sensors and status indicators 36 such as an ambient light sensor, a proximity sensor, a temperature sensor, a pressure sensor, a magnetic sensor, an accelerometer, and light-emitting diodes and other components for gathering information about the environment in which device 10 is operating and providing information to a user of device 10 about the status of device 10.

Audio components 38 may include speakers and tone generators for presenting sound to a user of device 10 and microphones for gathering user audio input.

Display 14 may be used to present images for a user such as text, video, and still images. Sensors 36 may include a touch sensor array that is formed as one of the layers in display 14.

User input may be gathered using buttons and other input-output components 40 such as touch pad sensors, buttons, joysticks, click wheels, scrolling wheels, touch sensors such as sensors 36 in display 14, key pads, keyboards, vibrators, cameras, and other input-output components.

Figure 6:
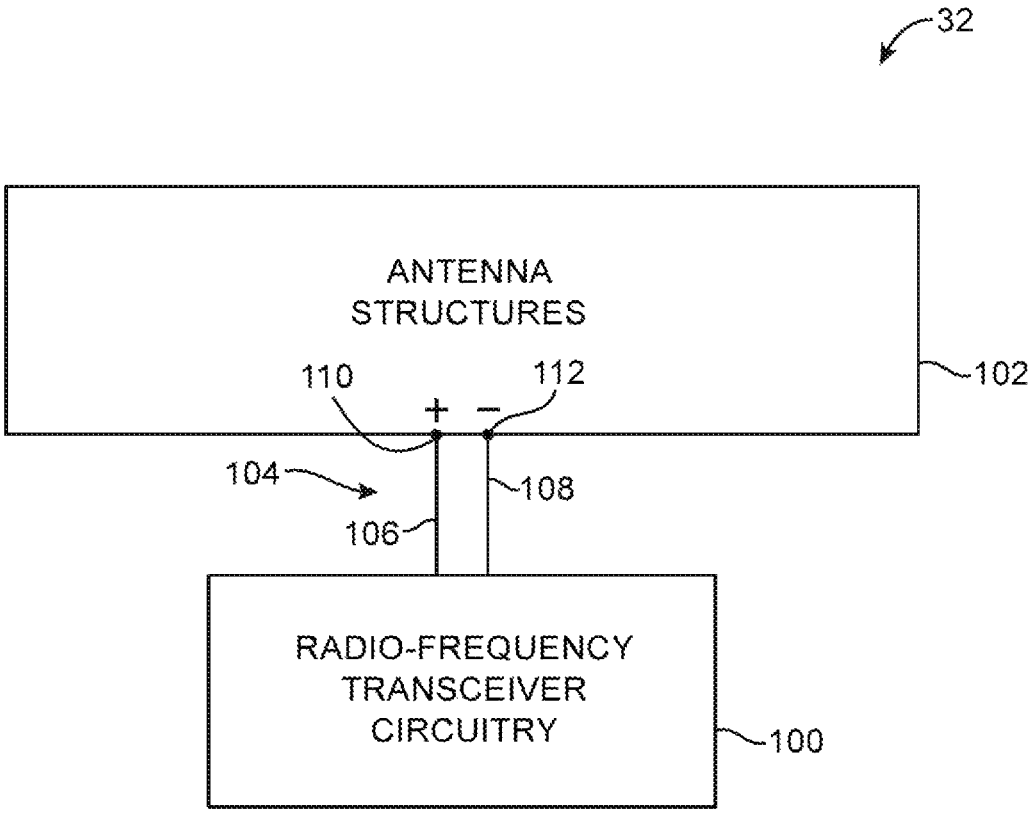
FIG. 6 is a schematic diagram of radio-frequency transceiver circuitry and antenna structures in accordance with an embodiment of the present invention.

As shown in FIG. 6, communications circuitry 32 may include wireless communications circuitry such as radio-frequency transceiver circuitry 100 and antenna structures 102. Communications circuitry 32 may include wireless circuitry formed from one or more integrated circuits, power amplifier circuitry, low-noise input amplifiers, passive radio-frequency components, one or more antennas such as antenna structures 102, and other circuitry for handling radio-frequency wireless signals.

Communications circuitry 32 may include radio-frequency transceiver circuits for handling multiple radio-frequency communications bands. For example, transceiver circuitry 100 may include circuits for handling cellular telephone communications, wireless local area network signals, and satellite navigation system signals such as signals at 1575 MHz from satellites associated with the Global Positioning System. Transceiver circuitry 100 may handle 2.4 GHz and 5 GHz bands for WiFi® (IEEE 802.11) communications and may handle the 2.4 GHz Bluetooth® communications band. Circuitry 100 may include cellular telephone transceiver circuitry for handling wireless communications in cellular telephone bands such as the bands in the range of 700 MHz to 2.7 GHz (as examples).

Communications circuitry 32 can include wireless circuitry for other short-range and long-range wireless links if desired. For example, circuitry 32 may include wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Communications circuitry 32 may include antenna structures 102. Antenna structures 102 may include one or more antennas. Antenna structures 102 may include inverted-F antennas, patch antennas, loop antennas, monopoles, dipoles, single-band antennas, dual-band antennas, antennas that cover more than two bands, or other suitable antennas. Configurations in which at least one antenna in device 10 is formed using loop antenna structures are sometimes described herein as an example.

To provide antenna structures 102 with the ability to cover communications frequencies of interest, antenna structures 102 may, if desired, be provided with tunable circuitry that is controlled by control circuitry 29. For example, control circuitry 29 may supply control signals to tunable circuitry in antenna structures 102 during operation of device 10 whenever it is desired to tune antenna structures 102 to cover a desired communications band.

Transceiver circuitry 100 may be coupled to antenna structures 102 by signal paths such as signal path 104. Signal path 104 may include one or more transmission lines. As an example, signal path 104 of FIG. 6 may be a transmission line having a positive signal conductor such as line 106 and a ground signal conductor such as line 108. Lines 106 and 108 may form parts of a coaxial cable or a microstrip transmission line having an impedance of 50 ohms (as an example). A matching network formed from components such as inductors, resistors, and capacitors may be used in matching the impedance of antenna structures 102 to the impedance of transmission line 104. Matching network components may be provided as discrete components (e.g., surface mount technology components) or may be formed from housing structures, printed circuit board structures, traces on plastic supports, etc.

Transmission line 104 may be coupled to antenna feed structures associated with antenna structures 102. As an example, antenna structures 102 may form an antenna having an antenna feed with a positive antenna feed terminal such as terminal 110 and a ground antenna feed terminal such as ground antenna feed terminal 112. Positive transmission line conductor 106 may be coupled to positive antenna feed terminal 110 and ground transmission line conductor 108 may be coupled to ground antenna feed terminal 112. Other types of antenna feed arrangements may be used if desired. The illustrative feed configuration of FIG. 6 is merely illustrative.

Antenna structures 102 may be formed from metal traces or other patterned conductive material supported by a dielectric carrier. With one suitable arrangement, antenna structures 102 may be based on loop antenna structures. For example, antenna structures 102 may include a strip of conductive material that is wrapped into a loop. Because the strip of conductive material has an associated width across which material is distributed, loop antenna structures such as these may sometimes be referred to as distributed loop antenna structures. A distributed loop antenna may be fed using a direct feeding arrangement in which feed terminals such as terminals 110 and 112 are coupled directly to the strip of material that forms the loop, may be fed indirectly by using near-field electromagnetic coupling to couple a loop antenna feeding element or other element to the loop that is formed from the strip of material, or may be fed using other suitable feed arrangements.

Figure 7:
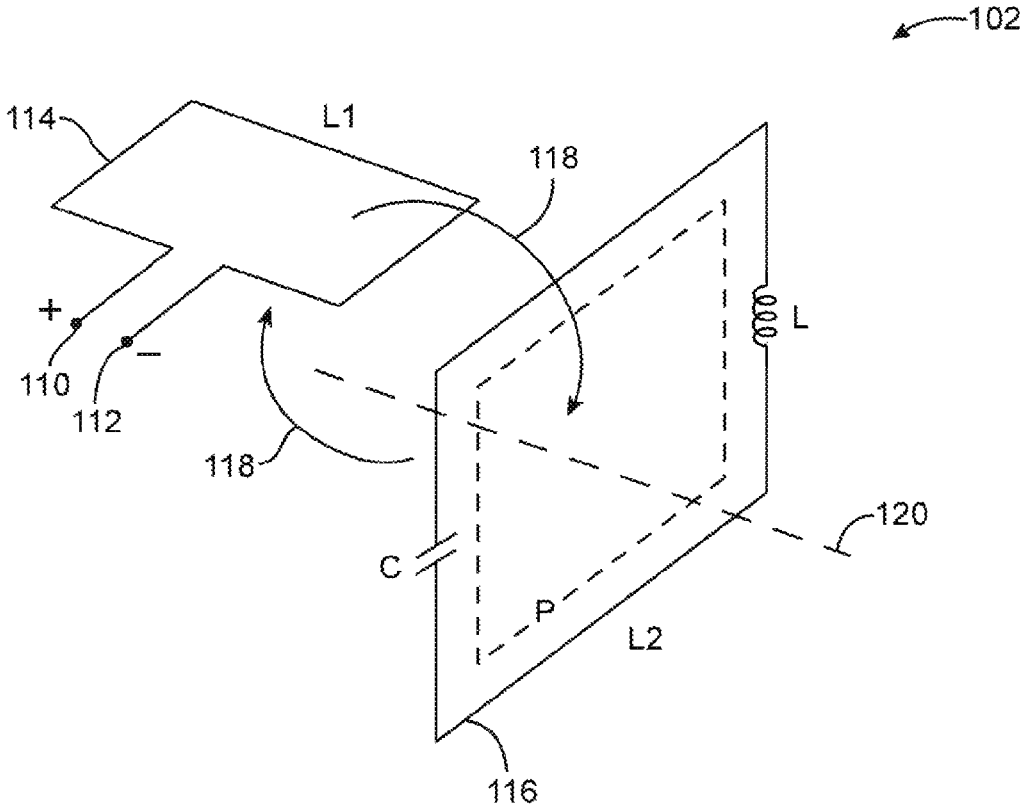
FIG. 7 is a diagram of illustrative loop antenna structures in accordance with an embodiment of the present invention.

A schematic diagram of a distributed loop antenna of the type that may be used in electronic devices 10 of FIGS. 1, 2, 3, and 4 is shown in FIG. 7. As shown in FIG. 7, distributed loop antenna structures 102 (sometimes referred to as distributed loop antenna 102) may include a first loop antenna resonating element L1 that is formed from a loop of conductor such as conductor 114 and a second loop antenna resonating element L2 (a distributed loop element) that is formed from a loop of conductor such as conductor 116.

As shown in FIG. 7, loop antenna resonating element L2 may be indirectly fed using loop-shaped antenna resonating element L1, which serves as an indirect antenna feeding structure. As illustrated by electromagnetic fields 118 of FIG. 7, antenna element (feed structure) L1 and loop-shaped antenna resonating element L2 may be coupled using near-field electromagnetic coupling.

Antenna structures 102 of FIG. 7 may be coupled to radio-frequency transceiver circuitry 100 (FIG. 6) using transmission line 104. For example, positive transmission line conductor 106 may be coupled to positive antenna feed terminal 110 and ground transmission line conductor 108 may be coupled to ground antenna feed terminal 112.

In the illustrative configuration of FIG. 7 in which the conductive lines of transmission line 104 are coupled to the feed terminals 110 and 112 of antenna element L1, antenna resonating element L2 may be indirectly fed. If desired, antenna resonating element L2 may be directly fed by coupling transmission line 104 across pairs of terminals in element L2. Indirect feeding arrangements for loop antenna structures 102 may sometimes be described herein as an example. This is, however, merely illustrative. In general, any suitable feeding arrangement may be used for feeding antenna 102 if desired.

Loop antenna structures 102 may be formed using conductive antenna resonating element structures such as metal traces on a dielectric carrier. The dielectric carrier may be formed from glass, ceramic, plastic, or other dielectric material. As an example, the dielectric carrier may be formed from a plastic support structure. The plastic support structure may, if desired, be formed from a speaker box enclosure that serves as a resonant cavity for a speaker driver.

The conductive structures that form loop antenna structures 102 may include wires, metal foil, conductive traces on printed circuit boards, portions of conductive housing structures such as conductive housing walls and conductive internal frame structures, and other conductive structures.

As shown in FIG. 7, antenna resonating element L2 may have a longitudinal axis such as axis 120. Axis 120 may sometimes be referred to as the longitudinal axis of loop distributed loop antenna structures 102. Loop antenna structures 102 may have resonating element conductive structures that are spread out ("distributed") along longitudinal axis 120 of loop L2.

Conductive structures 116 in resonating element loop L2 of antenna structures 102 may include a strip or sheet of conductor that has a first dimension that is wrapped around longitudinal axis 120 and a second dimension (i.e., a width W) that extends along the length of longitudinal axis 120. Conductive structures 116 may wrap around axis 120. During operation, antenna currents can flow within the strip-shaped conductive material of loop L2 around axis 120. In effect, conductive material 116 will form a wide strip of conductor in the shape of a loop that is characterized by a perimeter P. The antenna currents flowing in loop L2 tend to wrap around longitudinal axis 120. When installed within device 10, longitudinal axis 120 of antenna element L2 may extend parallel to an adjacent edge of housing 12 in electronic device 10 (as an example).

It may be desirable to form distributed loop antenna structures 102 from conductive structures that exhibit a relatively small dimension P. In a loop without any break along periphery P, the antenna may resonate at signal frequencies where the signal has a wavelength approximately equal to P. In compact structures with unbroken loop shapes, the frequency of the communications band covered by antenna loop L2 may therefore tend to be high. By incorporating a gap or other capacitance-generating structure into the loop, a capacitance C can be introduced into antenna loop L2. Conductive material 116 may also be configured to form one or more inductor-like paths to introduce inductance L into antenna loop L2. Material 116 may, for example, be configured to produce segments of conductive material 116 within loop L2 that serve as inductance-producing wires. With the presence of capacitance C and inductance L within the perimeter of loop antenna element L2, the resonant frequency of antenna element L2 may be reduced to a desired frequency of operation without enlarging the value of perimeter P.

Figure 8:
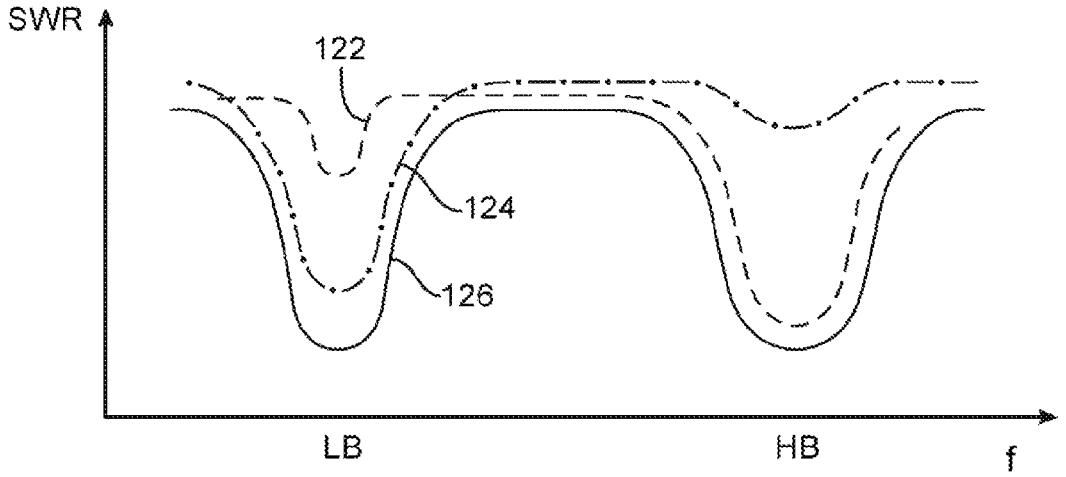
FIG. 8 is a graph of antenna performance as a function of operating frequency for an illustrative antenna of the type shown in FIG. 7 in accordance with an embodiment of the present invention.

FIG. 8 is a graph in which antenna performance (standing wave ratio) for antenna structures such as antenna structures 102 of FIG. 7 has been plotted as a function of operating frequency. In the example of FIG. 8, antenna structures 102 have been configured to resonate in a lower frequency band LB and a higher frequency band HB. Communications bands LB and HB may be cellular telephone bands, satellite navigation system bands, local area network bands, and/or other suitable communications bands. As an example, low band LB may be associated with a 2.4 GHz wireless local area network band and high band HB may be associated with a 5 GHz wireless local area network band (as an example).

Dashed curve 122 of FIG. 8 corresponds to the contribution of loop antenna resonating element L1 to the performance of antenna structures 102. Dashed-and-dotted curve 124 corresponds to the contribution of loop antenna resonating element L2 to the performance of antenna structures 102.

During operation, both elements L1 and L2 contribute to the overall performance of antenna structures 102 represented by curve 126. At lower frequencies such as frequencies in low band LB, antenna resonating element L2 serves at the primary radiating element in structures 102 and antenna resonating element L1 serves as a secondary radiating element in structures 102. At higher frequencies such as frequencies in high band HB, antenna resonating element L1 serves as the primary radiating element in antenna structures 102 and antenna resonating element L2 serves as a secondary radiating element.

A dielectric carrier for antenna structures 102 may be formed from plastic. As an example, a hollow plastic structure may be used to serve as a carrier for antenna structures 102. If desired, a hollow plastic antenna carrier structure may be used to form a speaker enclosure (sometimes referred to as a speaker box). A speaker driver may be mounted within the speaker box to produce sound.

Figure 9:
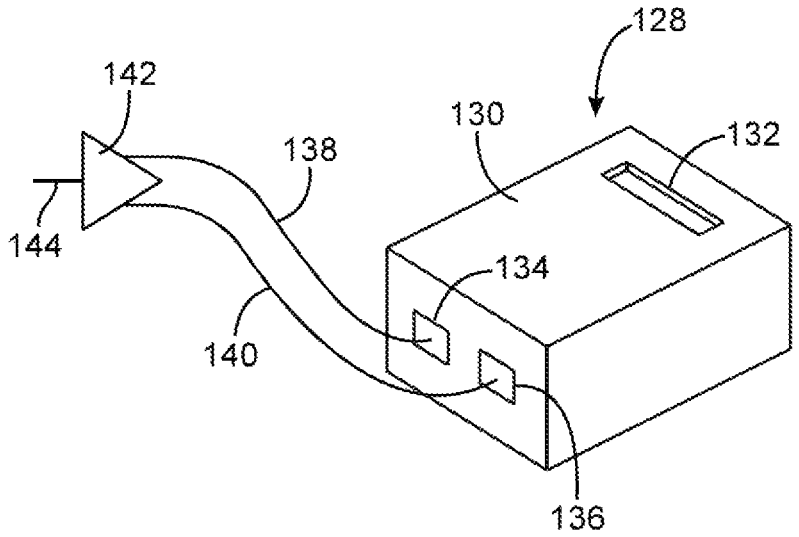
FIG. 9 is a perspective view of an illustrative speaker driver in accordance with an embodiment of the present invention.

FIG. 9 is a diagram of an illustrative speaker driver. As shown in FIG. 9, speaker driver 128 may have a speaker driver housing such as housing 130. Housing 130 may be formed from plastic, metal, or other suitable materials. An opening such as speaker driver port 132 may be formed in housing 130 to allow sound to exit driver 128.

Speaker driver 128 may have electrical terminals such as terminals 134 and 136. Wires such as wires 138 and 140 may be coupled to terminals 134 and 136. For example, wire 138 may be used to couple one of the outputs of audio amplifier 142 to terminal 134 and wire 140 may be used to couple another of the outputs of audio amplifier 142 to terminal 136. During operation, audio amplifier 142 may receive audio signals via input 144 (e.g., from control circuitry 29) and may drive corresponding analog audio signals onto lines 138 and 140. Speaker driver 128 may respond by creating sound that exits driver 128 through port 132.

It may be desirable to insulate conductive portions of speaker driver 128 to help ensure that antenna currents do not flow through speaker driver 128. If speaker driver 128 is not insulated, there is a potential for speaker driver 128 to couple to antenna structures 102, which could adversely affect antenna performance.

Figure 10:
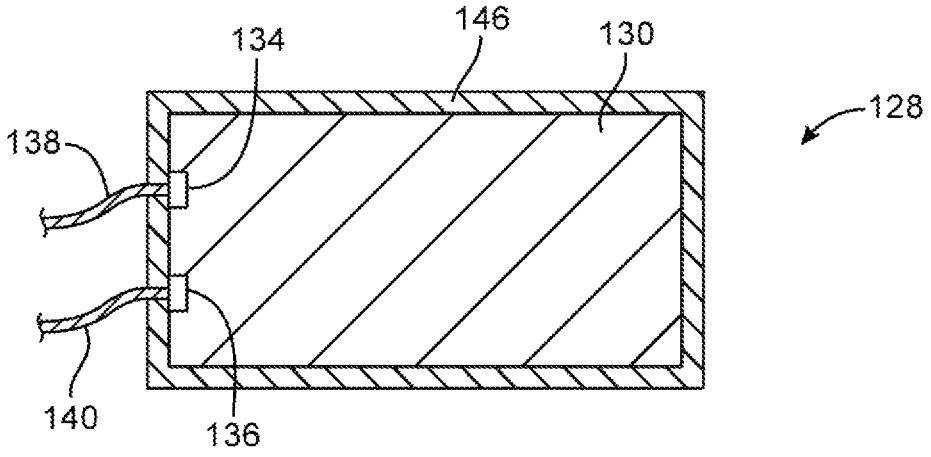
FIG. 10 is a cross-sectional side view of an illustrative speaker driver showing how the speaker driver housing may be coated with an insulating coating in accordance with an embodiment of the present invention.

As shown in the cross-sectional side view of FIG. 10, speaker driver 128 may have a coating such as coating 146 on housing 130. Housing 130 or parts of housing 130 may be formed from a conductive material such as metal. Coating 146 may be formed from plastic or other insulating material. As shown in FIG. 10, coating 146 may cover potentially conductive portions of speaker driver 128 such as housing 130 and terminals 134 and 136, thereby helping to ensure that speaker driver 128 is electrically isolated from surrounding structures. Insulating coating 146 may be used to help allow speaker driver 128 to electrically float with respect to ground (and antenna structures 102) and thereby minimize coupling with antenna structures 102.

Figure 11:
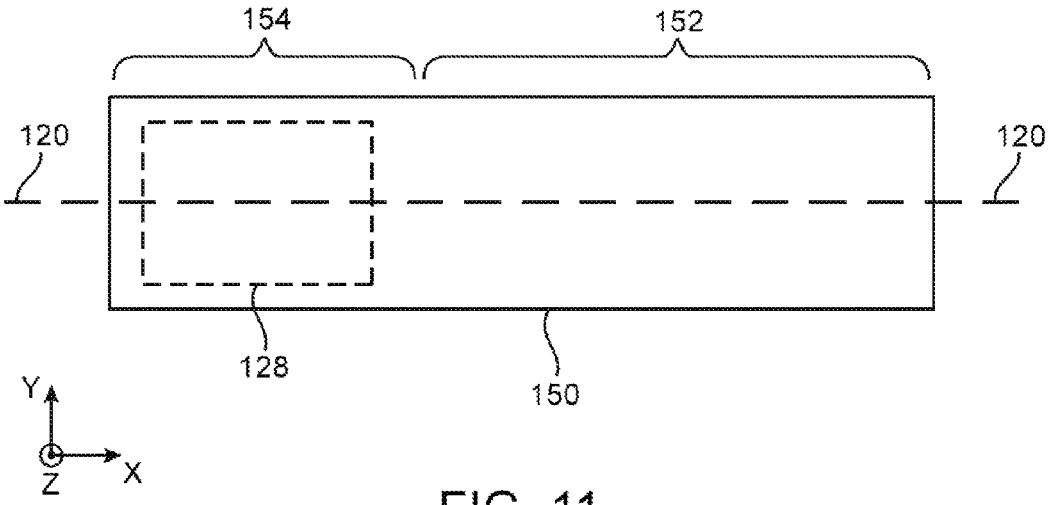
FIG. 11 is a top view of an illustrative speaker box of the type that may be used as an antenna carrier in accordance with an embodiment of the present invention.

FIG. 11 is a top view of an illustrative dielectric carrier of the type that may serve as both an antenna carrier for the conductive structures of antenna structures 102 and as a speaker enclosure for speaker driver 128. As shown in FIG. 11, dielectric carrier 150 may have an elongated shape that extends along longitudinal axis 120. Conductive structures for antenna structures 102 may be formed in regions 154 and 152. For example, conductive structures 116 associated with antenna resonating element loop L2 may be formed in region 152 and conductive structures 114 associated with antenna resonating element loop L1 may be formed in region 154. Dielectric carrier 150 may have a hollow interior that serves as an acoustic cavity for a speaker. Speaker driver 128 may be mounted within the hollow interior of carrier 150 under loop element L1. The distributed loop design of FIG. 11 may help ensure that electric field strength is minimized in the vicinity of speaker driver 128 during operation of antenna structures 102, thereby minimizing electrical coupling between antenna structures 102 and speaker driver 128.

Figure 12:
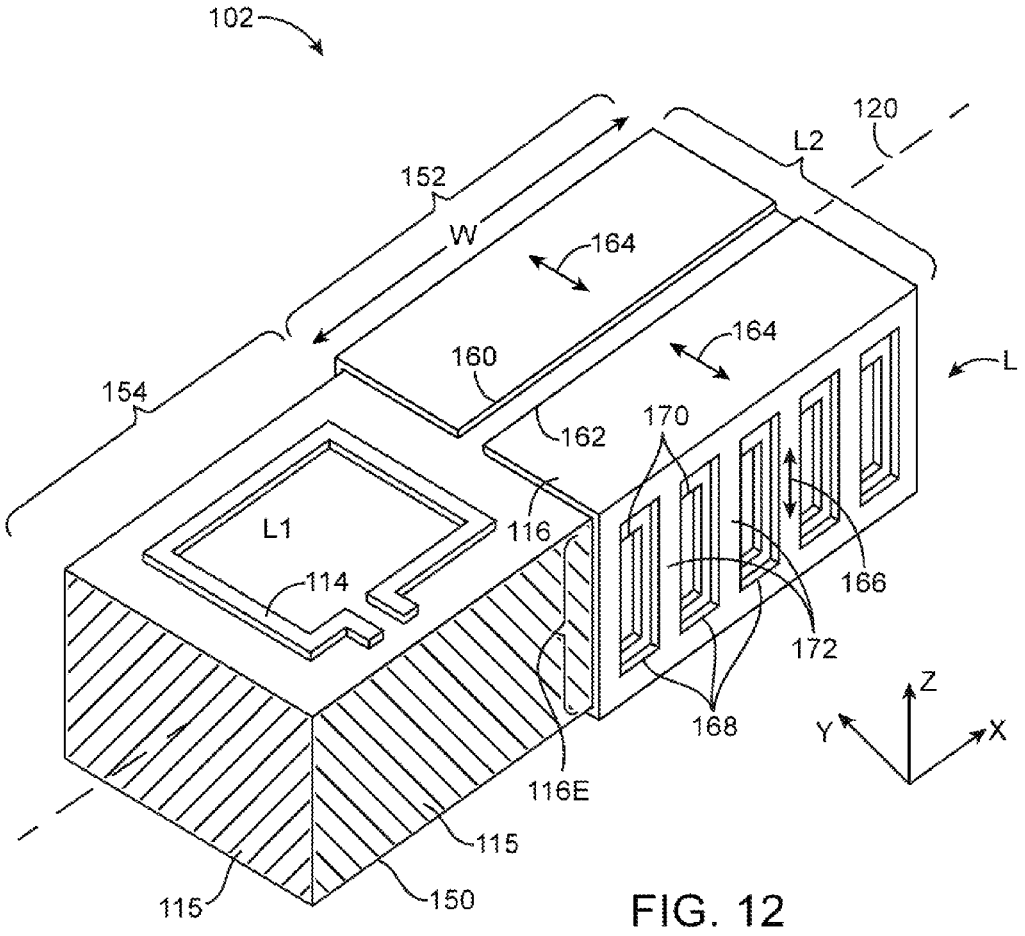
FIG. 12 is a perspective view of an illustrative distributed loop antenna formed using conductive traces on dielectric antenna carrier such as a speaker box in accordance with an embodiment of the present invention.

FIG. 12 is a perspective view of antenna structures 102 showing how conductive structures for antenna structures 102 may be formed on and around a speaker enclosure or other dielectric carrier 150. As shown in FIG. 12, antenna resonating element loop L1 may be formed from metal traces 114 on the upper surface of speaker enclosure 150 (or other dielectric carrier). Antenna resonating element loop L2 may be formed from a strip of metal traces 116 of width W on the surfaces of speaker enclosure 150. During operation, antenna currents may flow in loop L2 such as currents 164 and 166.

If desired, antenna resonating element loop traces 114 may be mounted in a ground cavity (i.e., loop L1 may be mounted in a cavity-backed antenna environment). For example, metal traces may be formed on the sidewalls of carrier 150 to the front, rear, side, and beneath traces 114 (see, e.g., cavity sidewalls 115 of FIG. 12). By placing traces 114 within antenna cavity 115, loop antenna resonating element can be decoupled from surrounding metal structures in device 10 (i.e., the performance of loop antenna L1 will not be affected by variations in the distance between carrier 150 and nearby conductive structures due to the isolation afforded by antenna cavity 115).

A gap may be formed between opposing edges 160 and 162 of traces 116 on the upper surface of enclosure 150. The layout of this gap may be configured to produce a desired value for capacitance C (FIG. 7). If, for example, a large value of C is desired, edges 160 and 162 may be placed closer together and/or the paths that edges 160 and 162 follow may be implemented using a meandering pattern that maximizes the lengths of edges 160 and 162.

Traces 116 may form a strip of material of width W that wraps around axis 120 on the surface of enclosure 150. Inductance L may be produced by forming openings 168 in a portion of traces 116 such as portion 116E. Openings 168 may have the shapes of slots or other openings that run parallel to each other, giving rise to narrow metal line segments such as segments 172 through which antenna currents 166 pass. Segments 172 may be relatively long and thin and may therefore serve as inductive elements. Segments 172 may collectively produce inductance L in loop L2.

Enclosure 150 may contain speaker driver 128. To ensure that sound can escape from enclosure 150 when playing audio with speaker driver 128, enclosure 150 may be provided with openings such as speaker enclosure openings 170. Openings 170 may be formed in the shape of circular holes, oval holes, rectangular slots, or openings of other shapes. Enclosure 150 may have walls with a thickness of 0.2 to 2 mm (as an example). Rectangular slot openings 170 may have lengths of 3-4 mm or 1-8 mm and widths of 0.2 to 1 mm (as examples). Segments 172 may have lengths of 3-4 mm or 1-8 mm and widths of 0.2 to 1 mm (as examples). As shown in FIG. 12, enclosure openings 170 and metal trace openings 168 may overlap each other (e.g., openings 168 may be aligned with openings 170 and may be sufficiently large to ensure that portions of metal traces 116 do not block enclosure openings 170). This allows sound to exit the hollow interior of enclosure 150 when speaker driver 128 is in use.

Figure 13:
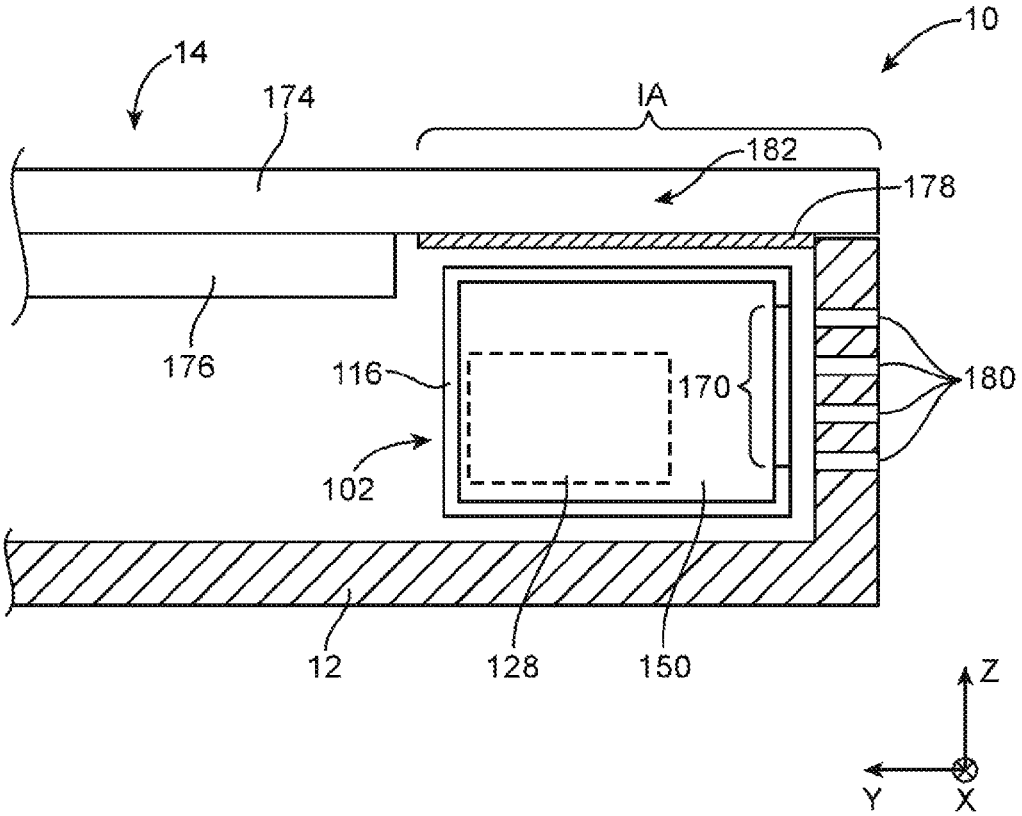
FIG. 13 is a cross-sectional side view of an illustrative antenna mounted within an electronic device housing in accordance with an embodiment of the present invention.

FIG. 13 is a cross-sectional side view of a portion of electronic device 10 showing how antenna structures 102 may be mounted along an edge of housing 12. As shown in FIG. 13, electronic device 10 may have a display such as display 14 that has an associated display module 176 and display cover layer 174. Display module 176 may be a liquid crystal display module, an organic light-emitting diode display, or other suitable display for producing images for a user. Display cover layer 174 may be a clear sheet of glass, a transparent layer of plastic, or other transparent member. If desired, display cover layer 174 may form a portion of display module 176.

In inactive display border region IA, the inner surface of display cover layer 174 may be coated with a layer of black ink or other opaque masking layer 178 to hide internal device structures from view by a user. Antenna structures 102 may be mounted within housing 12 under opaque masking layer 178. During operation, antenna signals may be transmitted and received through portion 182 of display cover layer 174 and, if desired, through dielectric portions of housing 12.

Housing 12 in the configuration of FIG. 13 has been formed from metal. Openings 180 in housing 12 may serve as speaker openings. Openings 170 in speaker enclosure 150 and openings 168 in loop antenna traces 116 may be aligned with housing openings 180. During operation of speaker driver 128, sound may escape from the interior of speaker enclosure 150 through openings 170, 168, and 180.

Figure 14:
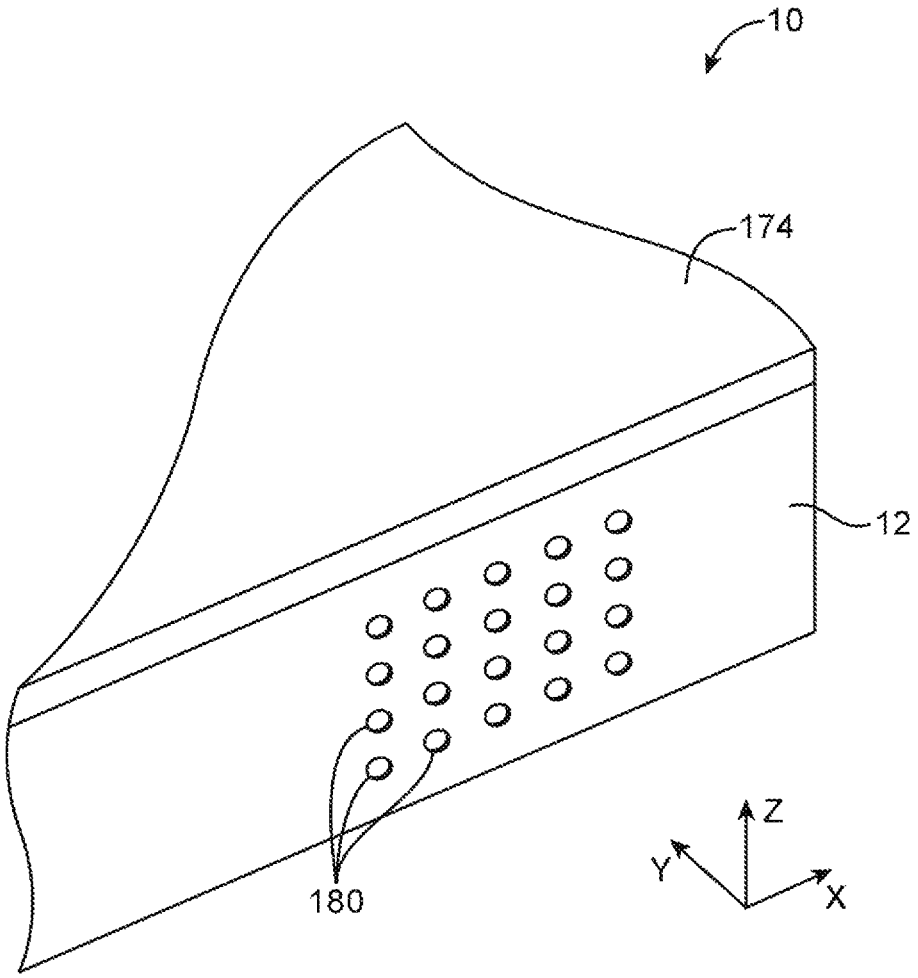
FIG. 14 is a perspective view of a portion of an electronic device showing how the electronic device may have a housing with speaker holes in accordance with an embodiment of the present invention.

FIG. 14 is a perspective view of an exterior portion of device 10 in the vicinity of speaker openings 180. Speaker openings 180 may be organized in an array having rows and columns (as an example). Each column of speaker openings 180 in device 10 of FIG. 14 may be aligned with a respective one of the slot-shaped trace openings 168 and enclosure openings 170 of FIG. 12.

Figure 15:
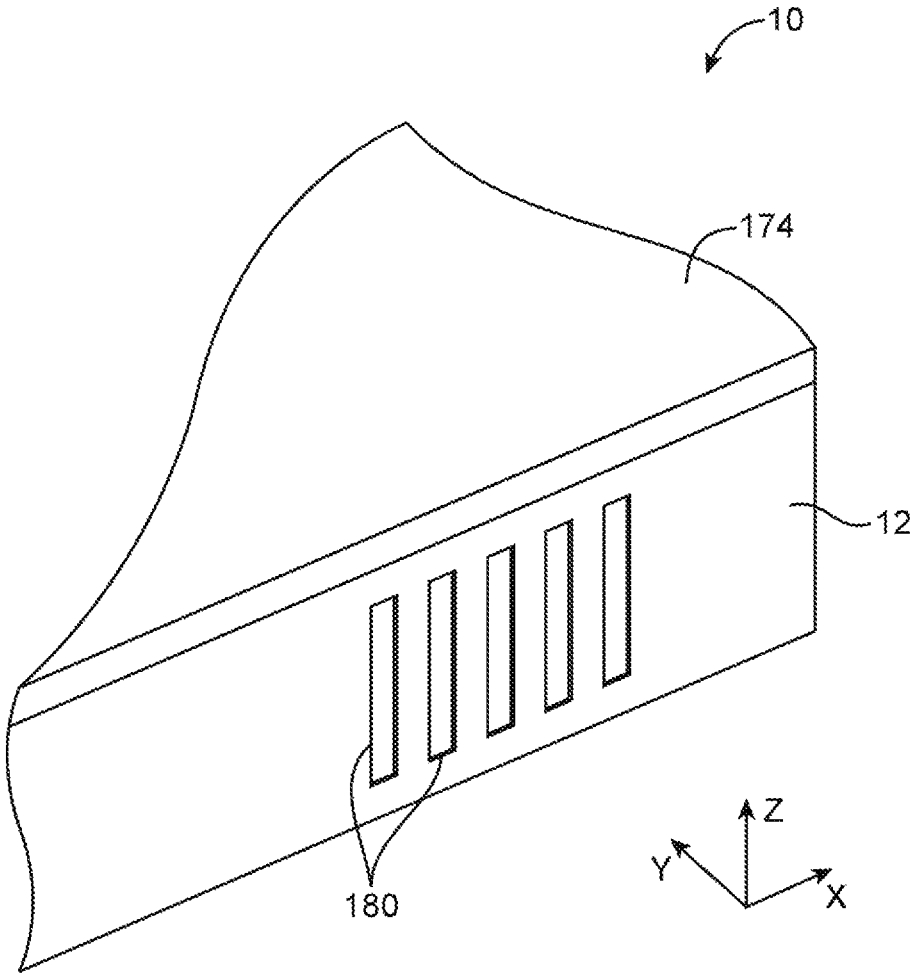
FIG. 15 is a perspective view of a portion of an electronic device showing how the electronic device may have a housing with speaker openings in the shape of slots in accordance with an embodiment of the present invention.

If desired, housing speaker openings 180 may have other shapes. As shown in FIG. 15, for example, speaker openings 180 may have rectangular slot shapes.

Figure 16:
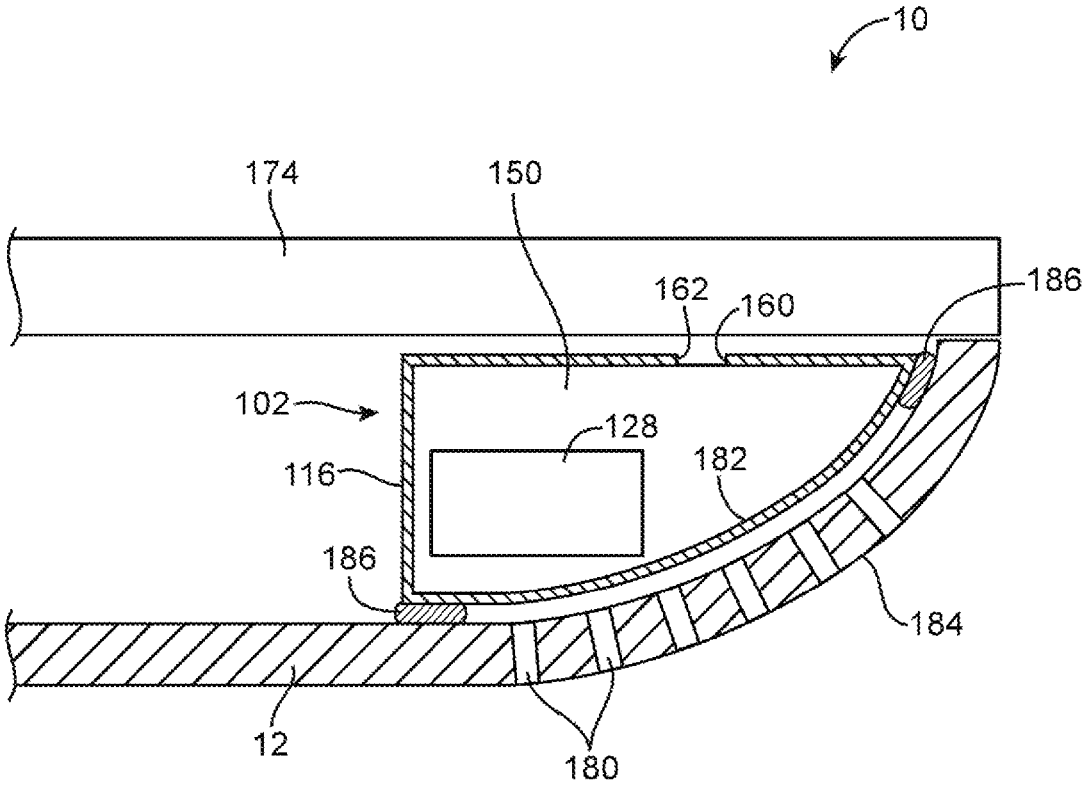
FIG. 16 is a cross-sectional side view of a portion of an electronic device showing how antenna structures in the electronic device may be mounted in accordance with an embodiment of the present invention.

FIG. 16 is a cross-sectional side view of device 10 showing how antenna structures 102 may have a non-rectangular cross-sectional shape. Antenna structures 102 may be formed, for example, from traces 116 on a speaker enclosure or other dielectric carrier 150 that has a curved wall. Curved wall 182 of speaker enclosure 150 may have a shape that matches the curved shape of wall portion 184 of electronic device housing 12.

Conductive structures such as conductive structures 186 may be used to electrically couple traces 116 to metal housing 12. When traces 116 are shorted to housing 12 in this way, a portion of the loop antenna currents in loop L2 may pass through housing 12 in parallel with underlying antenna traces 116 or, if desired, some of traces 116 may be omitted so that all of the loop antenna currents in a portion of loop L2 pass through housing 12 in parallel with enclosure 150. Structures 186 may be formed from metal tape, metal paint, conductive adhesive, solder, welds, fasteners such as screws, or other conductive structures.

Figure 17:
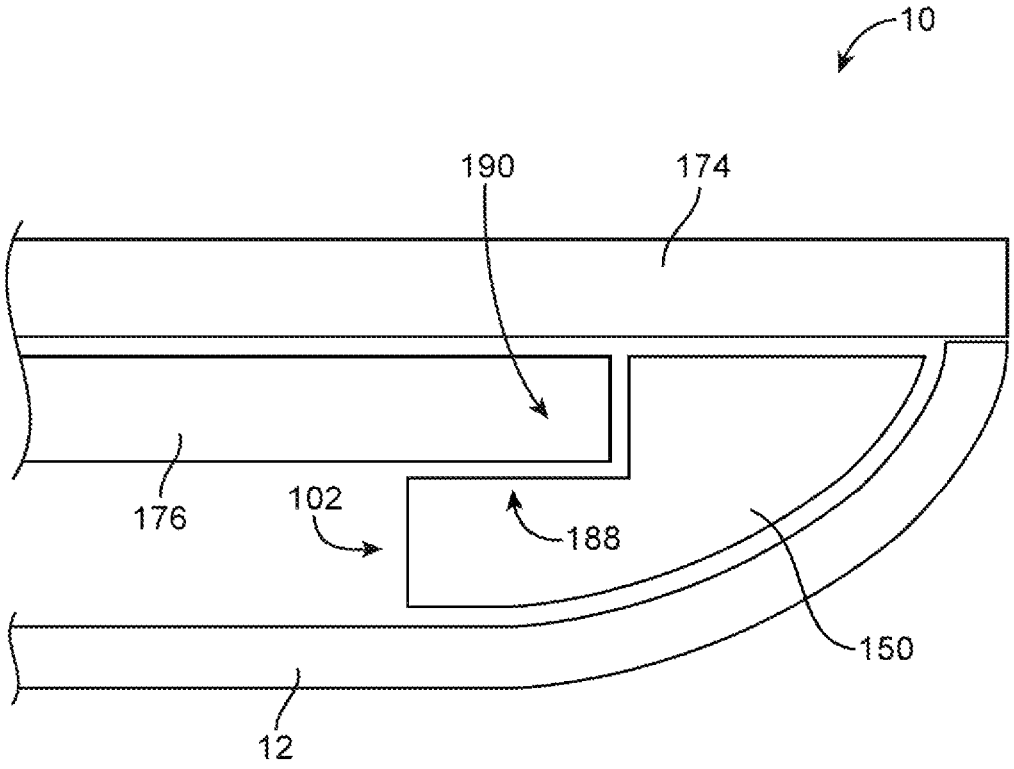
FIG. 17 is a cross-sectional side view of a portion of an electronic device having antenna structures with a recessed portion to accommodate an electronic component such as a display module in accordance with an embodiment of the present invention.

FIG. 17 is a cross-sectional side view of device 10 in a configuration in which dielectric carrier 150 (e.g., a speaker enclosure) in antenna structures 102 has been provided with a recess such as recess 188 to accommodate edge 190 of display structures 176. If desired, antenna structures 102 may have other shapes to accommodate other electrical or mechanical components in interior portions of device 10.

The foregoing is merely illustrative of the principles of this invention and various modifications can be made by those skilled in the art without departing from the scope and spirit of the invention.

What is claimed is:

1. An antenna, comprising:

a hollow speaker enclosure with first and second opposing sides;

a loop antenna resonating element that surrounds the hollow speaker enclosure, wherein a first portion of the loop antenna resonating element is adjacent to the first side of the hollow speaker enclosure and a second portion of the loop antenna resonating element is adjacent to the second side of the hollow speaker enclosure; and a plurality of openings in the hollow speaker enclosure, wherein the loop antenna resonating element has a plurality of openings that align with the plurality of openings in the hollow speaker enclosure.

2. The antenna defined in claim 1 further comprising a speaker driver in the hollow speaker enclosure.

3. The antenna defined in claim 1 further comprising an indirect antenna feed element that is configured to feed the antenna by electromagnetically coupling to the loop antenna resonating element.

4. The antenna defined in claim 1 wherein the loop antenna resonating element comprises a metal trace that forms a loop, the antenna further comprising a capacitance and an inductance interposed in the loop.

5. The antenna defined in claim 4 wherein the loop antenna resonating element comprises metal segments separated by openings in the loop antenna resonating element and wherein the metal segments collectively provide the inductance.

6. The antenna defined in claim 5 wherein the metal trace is formed on a surface of the hollow speaker enclosure.

7. The antenna defined in claim 1 further comprising:

an additional loop antenna resonating element on the hollow speaker enclosure that has antenna feed terminals; and a speaker driver within the hollow speaker enclosure under the additional loop antenna resonating element.

8. The apparatus defined in claim 1, the hollow speaker enclosure further comprising third and fourth opposing sides connected by the first and second opposing sides, wherein the first, second, third, and fourth sides of the hollow speaker enclosure define a cavity and a speaker driver is positioned in the cavity.

9. The antenna defined in claim 3, wherein the indirect feed element comprises an additional loop antenna resonating element on the hollow speaker enclosure.

10. The apparatus defined in claim 1, further comprising:

radio-frequency transceiver circuitry; and transmission line structures coupled between the radio-frequency transceiver circuitry and the first loop antenna resonating element.

11. An electronic device, comprising:

a metal housing having a plurality of speaker openings;

a speaker enclosure that extends along a longitudinal axis, wherein the longitudinal axis has first and second opposing sides; and antenna structures having a loop antenna resonating element that surrounds the speaker enclosure, wherein the loop antenna resonating element has a first portion on the first side of the longitudinal axis and a second portion on the second side of the longitudinal axis, and wherein the speaker enclosure has openings aligned with the plurality of speaker openings in the metal housing and the loop antenna resonating element has a plurality of openings aligned with the plurality of speaker openings in the metal housing.

12. The electronic device defined in claim 11 wherein the loop antenna resonating element comprises a strip of metal traces that surround at least some of the speaker enclosure.

13. The electronic device defined in claim 12 wherein segments of the metal traces that are interposed between the openings in the loop antenna resonating element are configured to form an inductance in the loop antenna resonating element.

14. The electronic device defined in claim 13 further comprising conductive material that electrically couples the metal traces to the metal housing.

15. The electronic device defined in claim 11 further comprising a speaker driver in the speaker enclosure.

16. The electronic device defined in claim 15 wherein the speaker driver has an insulating coating and electrically floats relative to the antenna structures.

17. The electronic device defined in claim 11, wherein the metal housing comprises a sidewall structure for the electronic device and the plurality of speaker openings are formed in the sidewall structure.

18. The electronic device defined in claim 17 wherein the sidewall structure comprises a curved housing surface and the plurality of speaker openings are formed in the curved housing surface.

19. The electronic device defined in claim 11, further comprising:

a display having a display cover layer, wherein the antenna structures are configured to transmit radio-frequency signals through a portion of the display cover layer.

20. Apparatus, comprising:

an elongated hollow plastic speaker enclosure that extends along a first longitudinal axis;

a speaker driver within the hollow speaker enclosure; and metal structures on the hollow plastic speaker enclosure, wherein the metal structures are configured to form a distributed loop antenna having first and second loop antenna resonating elements, the first loop antenna resonating element indirectly feeds the second loop antenna resonating element using near-field electromagnetic coupling, the second loop antenna resonating element extends around the first longitudinal axis, and the first loop antenna resonating element extends around a second longitudinal axis that is substantially perpendicular to the first longitudinal axis.

21. The apparatus defined in claim 20 wherein the hollow plastic speaker enclosure has speaker enclosure openings, the apparatus further comprising:

openings in the metal structures that overlap the speaker enclosure openings, wherein segments of the metal structures are formed between the openings in the metal structures and wherein the segments of the metal structures collectively form an inductance in the second loop antenna resonating element.

22. The apparatus defined in claim 21 further comprising a metal electronic device housing wall having openings that are aligned with the speaker enclosure openings.

23. The apparatus defined in claim 20, wherein the second loop antenna resonating element extends entirely around the longitudinal axis.

* * * * *